US010930108B2

(12) United States Patent
Daniels

(10) Patent No.: US 10,930,108 B2
(45) Date of Patent: Feb. 23, 2021

(54) GAMING DEVICE HAVING AN ADDITIONAL SYMBOL AWARD WITHIN A PLAY MATRIX

(71) Applicant: High 5 Games, LLC, New York, NY (US)

(72) Inventor: Brent Daniels, New York, NY (US)

( * ) Notice: Subject to any disclaimer, the term of this patent is extended or adjusted under 35 U.S.C. 154(b) by 101 days.

(21) Appl. No.: 15/645,681

(22) Filed: Jul. 10, 2017

(65) Prior Publication Data

US 2018/0012445 A1 Jan. 11, 2018

Related U.S. Application Data

(60) Provisional application No. 62/360,146, filed on Jul. 8, 2016.

(51) Int. Cl.
*G07F 17/32* (2006.01)

(52) U.S. Cl.
CPC ..... *G07F 17/3213* (2013.01); *G07F 17/3244* (2013.01); *G07F 17/3265* (2013.01); *G07F 17/3267* (2013.01); *G07F 17/3288* (2013.01)

(58) Field of Classification Search
CPC ..... G07F 17/3213; G07F 17/3288; G07F 17/3267
USPC ..... 463/20
See application file for complete search history.

(56) References Cited

U.S. PATENT DOCUMENTS

| | | | | |
|---|---|---|---|---|
| 7,758,414 | B1 * | 7/2010 | Marks | G07F 17/3211 273/138.1 |
| 2006/0068892 | A1 * | 3/2006 | Gomez | G07F 17/3244 463/20 |
| 2006/0247017 | A1 * | 11/2006 | Marks | G07F 17/3244 463/20 |
| 2007/0060248 | A1 * | 3/2007 | Rodgers | G07F 17/32 463/16 |
| 2007/0254735 | A1 * | 11/2007 | Marks | G07F 17/32 463/20 |
| 2010/0075740 | A1 * | 3/2010 | Suda | G07F 17/3244 463/20 |
| 2013/0187049 | A1 * | 7/2013 | Collin | G02B 1/005 250/338.1 |
| 2014/0031100 | A1 * | 1/2014 | Gomez | G07F 17/3265 463/20 |
| 2014/0221079 | A1 * | 8/2014 | Rucker | G07F 17/3267 463/21 |
| 2016/0379439 | A1 * | 12/2016 | Galasso | G07F 17/3227 463/21 |

(Continued)

*Primary Examiner* — Omkar A Deodhar
*Assistant Examiner* — Shauna-Kay Hall
(74) *Attorney, Agent, or Firm* — Jonathan Fallon, Esq.

(57) ABSTRACT

A game comprising: a plurality of reels, each of the reels comprising a plurality of symbol positions; a plurality of symbols, at least one of the plurality of symbols located in at least one of the plurality of symbol positions; a visible matrix comprising a plurality of matrix positions; a plurality of matrix positions designated as capture positions; a set of program instructions executable to implement: accepting a wager; receiving an instruction to initiate play of the game; determining a game outcome including a stop position for each of the plurality of reels; displaying a portion of the reels based on each reel's stop position in the visible matrix; determining whether to issue an award based on the symbols in the capture positions; and issuing an award if the program instructions so designate.

20 Claims, 11 Drawing Sheets

(56) References Cited

U.S. PATENT DOCUMENTS

2017/0046913 A1* 2/2017 Fong ..... G07F 17/3213

* cited by examiner

GAMING DEVICE HAVING AN ADDITIONAL SYMBOL AWARD WITHIN A PLAY MATRIX

CROSS-REFERENCE TO RELATED APPLICATIONS

The present application claims priority to U.S. Provisional Patent Application Ser. No. 62/360,146 entitled GAMING DEVICE HAVING ADDITIONAL SYMBOL AWARD WITHIN A PLAY MATRIX," filed Jul. 8, 2016 the disclosure of which is incorporated herein by reference in its entirety.

BACKGROUND

Field of the Invention

Embodiments of the present invention generally relate to a gaming device having positional symbol awards within a play matrix. More specifically, embodiments of the present invention relate to a slot machine having a variety of methods of play to enable specific symbols at predetermined locations to trigger additional potentially award events in the play matrix.

Description of Related Art

Slot games are immensely popular throughout the world. Slot games may generally be played on dedicated slot machines or many other electronic devices. For example, some slot games may be played on personal computers, tablet computers, mobile phones, smart televisions, and/or the like. Although many devices can execute slot games today, the term "slot" is derived originally from a coin accepting slot present in the earliest slot machines. Advances in technology have allowed newer slot machines and other electronic devices to accept other forms of payment and/or credits.

To play a conventional slot machine, a player deposits money in the form of coins, gaming tokens or paper currency either into a coin head or bill acceptor. The coins and gaming tokens are collected in a reservoir inside the gaming machine while the paper currency is collected in the bill acceptor inside the gaming machine. A currency detector, or the like, validates the coins, gaming tokens, paper currency, or other form of credits as authentic or not counterfeit. Currency detectors are generally known in gaming machines and slot machines. Currency detectors may include coin detectors, optical sensors, giant magnetoresistance (GMR) sensor proximity detectors, weight detectors, size detectors, thickness detectors, composition detectors, banknote validators/acceptors, token validators/acceptors, voucher validators/acceptors, magnetic stripe card validators/acceptors, barcode readers, and/or the like. A player may also deposit currency into certain slot machines by inserting, swiping, or scanning a payout ticket, a voucher, a member card, a credit card, a debit card, or the like into a validator. As used herein, the term "currency" may include real money, points, and/or credits.

Once the currency detector or validator authenticates the currency, a visual display may show the appropriate number of playing credits on a credit or playing meter. As used herein, the terms "visual display" or "display" may comprise an output device for presentation of information in accordance with the present disclosure. A display or visual display may work together with a processor and memory to display reels, symbols, credit counters, slot games, bonus games, videos, graphics, logos, all slot game features, components, and parts disclosed herein, and/or the like. For example, a display may be an electronic display, a digital display, a cathode ray tube display (CRT), a Light-emitting diode display (LED), an elec troluminescent display (ELD), an electronic paper display, an E Ink display, a Plasma display panel (PDP), a Liquid crystal display (LCD), a High-Performance Addressing display (HPA), a thin-film transistor display (TFT), an Organic light-emitting diode display (OLED), a Surface-conduction electron-emitter display (SED), a field emission display (FED), a laser TV, a carbon nanotubes display, a quantum dot display, an interferometric modulator display (IMOD), a digital microshutter display (DMS), a swept-volume display, a varifocal mirror display, an emissive volume display, a laser display, a holographic display, a light field display, a volumetric display, and/or the like. The playing credits may be shown via a credit meter, or the like, on a portion the display as a monetary amount, a number of spins, or some other multiplier of the monetary value or currency deposited. For example, a twenty-five cent gaming machine may accrue one credit for every twenty-five cents deposited or four credits for each dollar that is deposited into the gaming machine.

After accruing credits on the credit meter, the player determines how many credits he wishes to wager or risk (the "stake") on the next play of the game, which may include a spin of the slot reels. As used herein, a "reel" may include an arrangement of symbols. Traditional mechanical and electromechanical slot machines have a set of adjacent reels having symbols, numbers, pictures, or the like disposed in different positions on physical reels. Traditionally, mechanical or electromechanical slot machines include a number of rotating physical reels each having an outer circumferential reel strip printed with a number of play symbols usually consisting of items such as pictures of fruit, playing cards, other symbols, or the like. The reels are located in a side by side relationship for independent movement about a common axis. In the some electromechanical machines each of the reels are driven individually by a stepper motor that serves to rotate the reels about the common axis. In order to house the reels, conventional slot machines require a housing having a depth sufficient to accommodate the reels. These reels can be mounted on modules or reel mounting mechanisms which can each be separately inserted into the housing.

As slot game technology advanced, digital reel strips, or digital arrangements of symbols, became possible. Digital reel strips may be stored in memory and may include an arrangement of symbols. A visual representation of the reel strips may be displayed on a digital display, or the like, to simulate the visual effect of reels spinning as they would in a conventional mechanical or electromechanical slot game. The arrangement of symbols may include the possible game outcomes for a particular reel. Each reel may include one or more symbol positions where one or more symbols may be located. An outcome generally includes the stopping point of one or more reels, which may be displayed to the player. A number of symbols on a reel may be displayed in accordance with its stopping point determined by a processor. In traditional mechanical or electromechanical slot gaming machines, a window or aperture would be present allowing the player to see a portion of the reels. The player would see the reels physically spin during gameplay and eventually terminate at a stopping point, wherein a certain number of symbols would be displayed in the window.

There are many advantages to using digital reels over physical reels. While physical reels are limited to the number of symbols that can physically fit on the reels, digital reel strips can include any suitable number of symbols, often in the hundreds or thousands. In some electronic slot games, reels are arranged in reel strips having a length set by an administrator, or the like. To play the game, after setting a wager, the player initiates the game for example, by spinning the reels mechanically or digitally. The game may be initiated by an input device by a player by pressing a spin button or touch screen option, by pulling a handle, and/or the like.

In mechanical or electromechanical slot machines, such player action, in turn, triggers the start of the reel motors which rotate the reels. In digital slot games, the spinning of the reels may be simulated. The reels may then stopped at random positions, usually under control of a microprocessor, or the like. The machine determines if a reward should be issued to the player in accordance with a pay table that may be configured by an administrator. For example, given combinations of the play symbols displayed along a pay line may result in an award to the player. In traditional slot games, each spin of the reels is typically a separate and distinct game, which has no relationship with any prior or future game played on that machine. In some games with digital reels, a game, outcome including a stop position for each of the reels, is determined by the microprocessor and a video or digital simulation of reels spinning and coming to a stopping point may be shown on a display. When the reels stop spinning, or the like, symbols are displayed on the display and the results of the game are presented to the user. The player then collects credits for winning combinations, if any, according to a pay table.

Slot game symbols may be located on one or more reels. Reels may be physical reels, digital reel strips, and/or the like. Digital reel strips may include an arrangement of symbols stored digitally, or the like. Symbols disposed on a physical reel physically spin when the reel spins. Some electronic slot machines include a processor working with a display to depict a simulation of a reel spinning, or the like. A slot game may include a processor, memory, and a display working together to display a digital representation of a physical reel after a player activates a game.

As used herein, the term "symbol" may refer to an indicia or indicator. At the conclusion of a game or spin, certain combinations of symbols may result in a reward for the player. In physical reels, symbols are displayed on the reel at various points around the outer circumference of the slot reel. Digital reels include various symbol positions, or positions on the reel strips where symbols are positioned. Reels may be placed or displayed adjacent to each other, and are often arranged in columns. In most embodiments, there are at least three reels in the reel sets and most often at least five.

The visual display includes a visible display area whereby a player can see a portion of the reels. The visual display area (also called a "symbol matrix") displays a portion of each of the plurality of the reels. A typical example is a symbol matrix that displays a portion of three to five reels. In this typical example, the resulting symbol matrix is a rectangular display of symbols (nine symbols when three columns and three rows are visible and fifteen symbols when five columns and three rows are visible).

Within the symbol matrix, positions on the slot reels may be referred to according to column, from left to right, and row from top to bottom. For example, symbol matrix position 1/2 is located in column 1 (left-most column) and row 2 (second row from the top). In some embodiments, the visible display area may be a non-rectangular shape. For example, the visible display may display one row of the first reel, two rows of the second reel, and one row of the third reel. In this example, four symbol positions would be visible. In some embodiments, only one position on each reel is visible to a player ("independent reels"). In some of these embodiments, multiple reels are vertically aligned and appear to be one column to the player.

In some embodiments, there are hidden reels whereby none of the reel slots are visible. In some if these embodiments, the hidden reels become visible after a triggering event. The player collects credits for winning combinations based on the symbols displayed in the visible symbol matrix. In some embodiments, a player may collect additional credits for winning combinations based on symbols in non-visible positions on the reels or on symbols that are on hidden reels.

Players collect credits for predetermined winning symbol combinations that appear in specific positions (pay lines) on the slot reels. Winning combinations typically require that three or more of the same symbols appear adjacent to each other starting from the leftmost position of a pay line ("line pays"). For example, a player may collect a line pay if three banana symbols appeared in symbol positions 1/1, 2/1, and 3/1 on a pay line that includes symbol positions 1/1, 2/1, 3/1, 4/1, and 5/1.

A player may wager on the occurrence of a winning combination on a single pay line or on the occurrence of a winning combination on multiple pay lines. Winning combinations may also occur when three or more of the same symbols appear adjacent to each other starting from the rightmost position of a pay line. Game rules may specify that some symbols may form winning combinations if there are two or more of the same symbol ("majors") while other symbols may only form winning combinations if there are three or more of the same symbol.

Winning combinations may occur if three or more symbols appear on a pay line regardless of whether they are adjacent or regardless of whether the first occurrence of that symbol is in the leftmost or rightmost column. In some instances, there are wild symbols or substitute symbols that can be matched with other symbols. Players may also collect credits for predetermined winning combinations that appear anywhere on a pay line ("line scatter pays") or anywhere on the slot reels ("reel scatter pays"). For example, a player may collect a line scatter pay if three banana symbols appeared in symbol positions 1/1, 3/1, and 5/1 on a pay line using symbol positions 1/1, 2/1, 3/1, 4/1, and 5/1; and collect a reel scatter pay if three banana symbols appear anywhere on the visible slot reels.

Pay Table.

Credits are awarded to the player for each winning symbol combination based on a predetermined schedule. For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect ten times the amount indicated on the pay table for a reel scatter pay appearing on anywhere on the slot reels.

Following any type of pay (e.g., line pays, line scatter pays, or reel scatter pays), credits won are added to the player's credit balance shown on the credit meter. As long as the player has credits on the credit meter, the player may continue to play the game. Following any spin, the player may collect the credit balance by pressing a Cash Out button. Credits may be paid out in many different ways. Credits can be paid out as cash or cash alternatives or as credits to play the game.

Conventional slot machines are limited in that they only issue awards for the types of combinations of symbols as described above. That is, awards are paid only in accordance with a fixed pay table. As a result of this limitation, players must learn how and why certain combinations of symbols form winning combinations; players must memorize the awards listed on the pay table for each of the winning symbol combinations; players suffer from the disappointment of "near-misses" of winning combinations which line-up just off the pay lines; and players suffer from boredom of playing "new" games that really use the same, old "pay line-pay table" concept.

In other slot machines, players are awarded for the numerical value of symbols appearing on a display device without regard to their alignment. This concept, known as What You See Is What You Get ("WYSIWYG"). In these embodiments, players are issued awards based on each numeric symbol appearing in certain symbol positions that are displayed without regard to the alignment of the symbols as further disclosed in United States Patent Publication 2011-0165934 which is incorporated by reference in its entirety as if fully set forth herein.

While the above elements are common to many slot machine games, without more, players are often easily bored by simple conventional game play. A need exists for a gaming apparatus having an improved game play. Embodiments of the present invention may include a machine that provides cross-column numeric wins. Embodiments of the present invention may provide new and exciting game play while simultaneously simplifying visible wins.

SUMMARY

Embodiments of the present invention generally relate to a gaming device having positional symbol awards within a play matrix. More specifically, embodiments of the present invention relate to a slot machine having a variety of methods of play to enable specific symbols at predetermined locations to trigger additional potentially award events in the play matrix.

In some embodiments, game comprises a plurality of reels, each of the reels comprising a plurality of symbol positions; a plurality of symbols, at least one of the plurality of symbols located in at least one of the plurality of symbol positions; a play matrix comprising a portion of the plurality of reels; at least one designated position in the play matrix, wherein when a a set of program instructions executable to implement: accepting a wager; receiving an instruction to initiate play of the game; determining a game outcome including a stopping point of the plurality of reels; generating an award if a selected symbol appears in the at least one designated symbol position after a play of the game.

BRIEF DESCRIPTION OF THE DRAWINGS

So the manner in which the above recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1A:
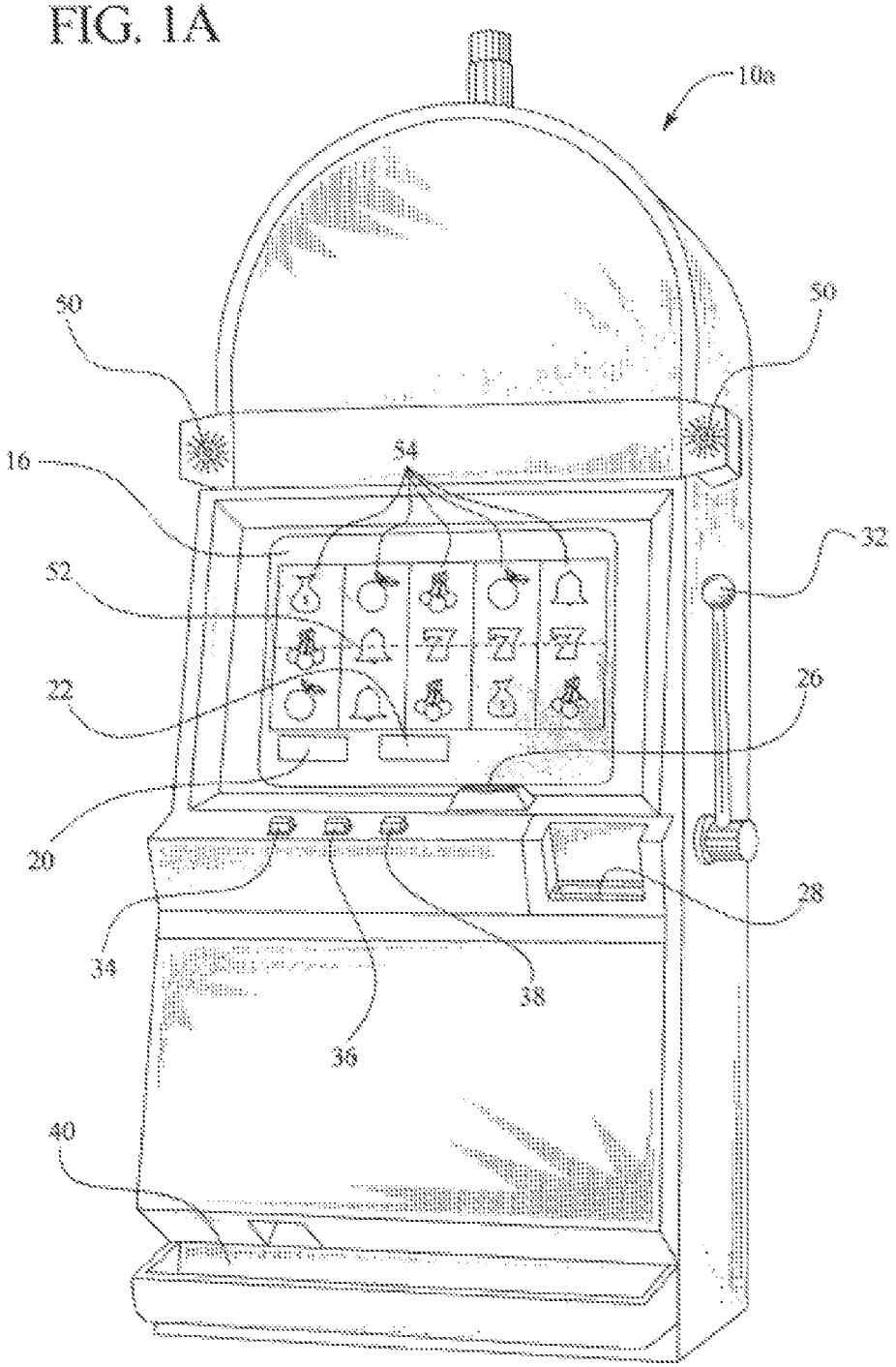
FIG. 1A depicts a front perspective view of a gaming device in the form of a slot machine in accordance with one embodiment of the present invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

In the following detailed description, numerous specific details are set forth in order to provide a thorough understanding of exemplary embodiments or other examples described herein. However, it will be understood that these examples may be practiced without the specific details. In other instances, well-known methods, procedures, and components have not been described in detail, so as to not obscure the following description. Furthermore, the examples disclosed herein are for exemplary purposes only and other examples may be employed in lieu of, or in combination with, the examples disclosed.

Embodiments of the present invention generally relate to a gaming device having positional symbol awards within a play matrix. More specifically, embodiments of the present invention relate to a slot machine having a variety of methods of play to enable specific symbols at predetermined locations to trigger additional potentially award events in the play matrix. In some embodiments, a game may be provided that includes a number (for example, two, three, four, or five) designated stops or positions on the symbol matrix. If selected symbol combinations (for example, two matching symbols or one symbol and one wild) appear in the designated stops, a secondary, potentially paying event may be triggered.

Figure 1B:
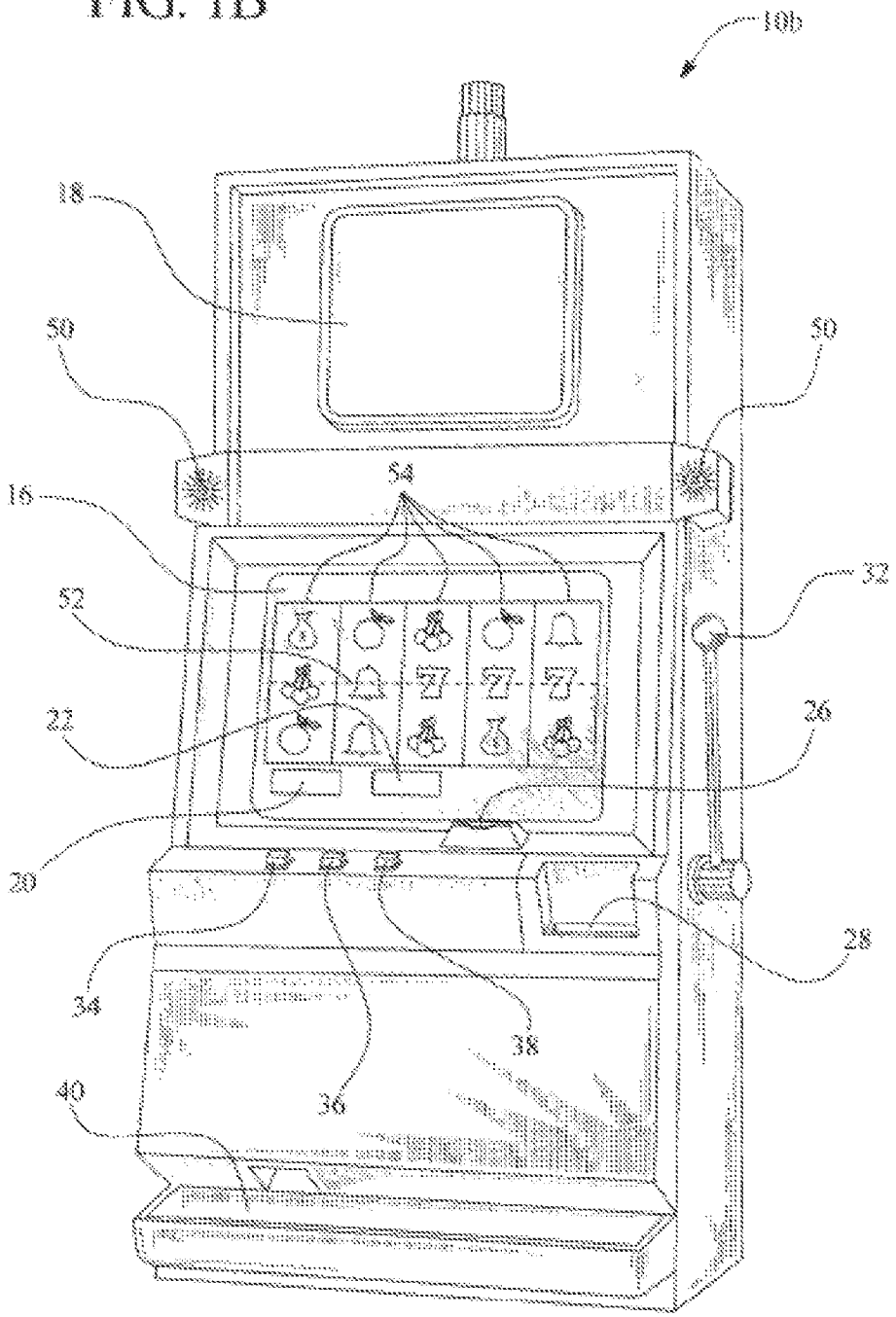
FIG. 1B depicts a front perspective view of a gaming device in the form of a slot machine in accordance with another embodiment of the present invention.

Some embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 1C:
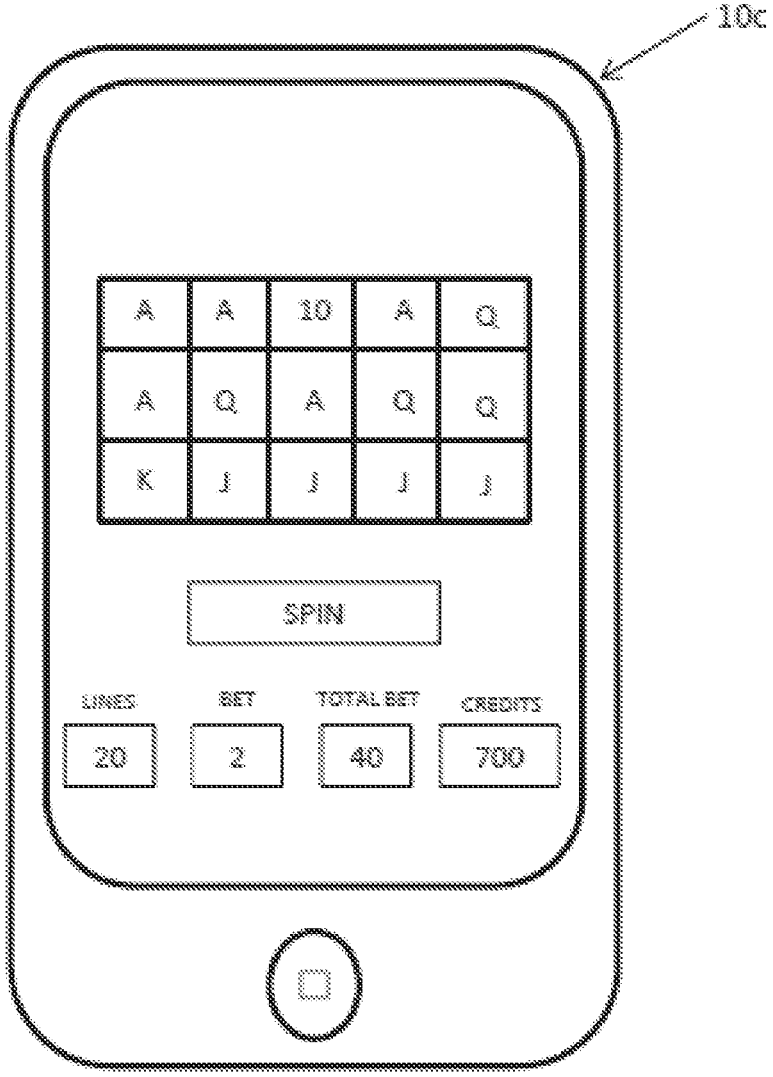
FIG. 1C depicts a front perspective view of a gaming device in the form of a mobile device in accordance with one embodiment of the present invention.
Figure 1D:
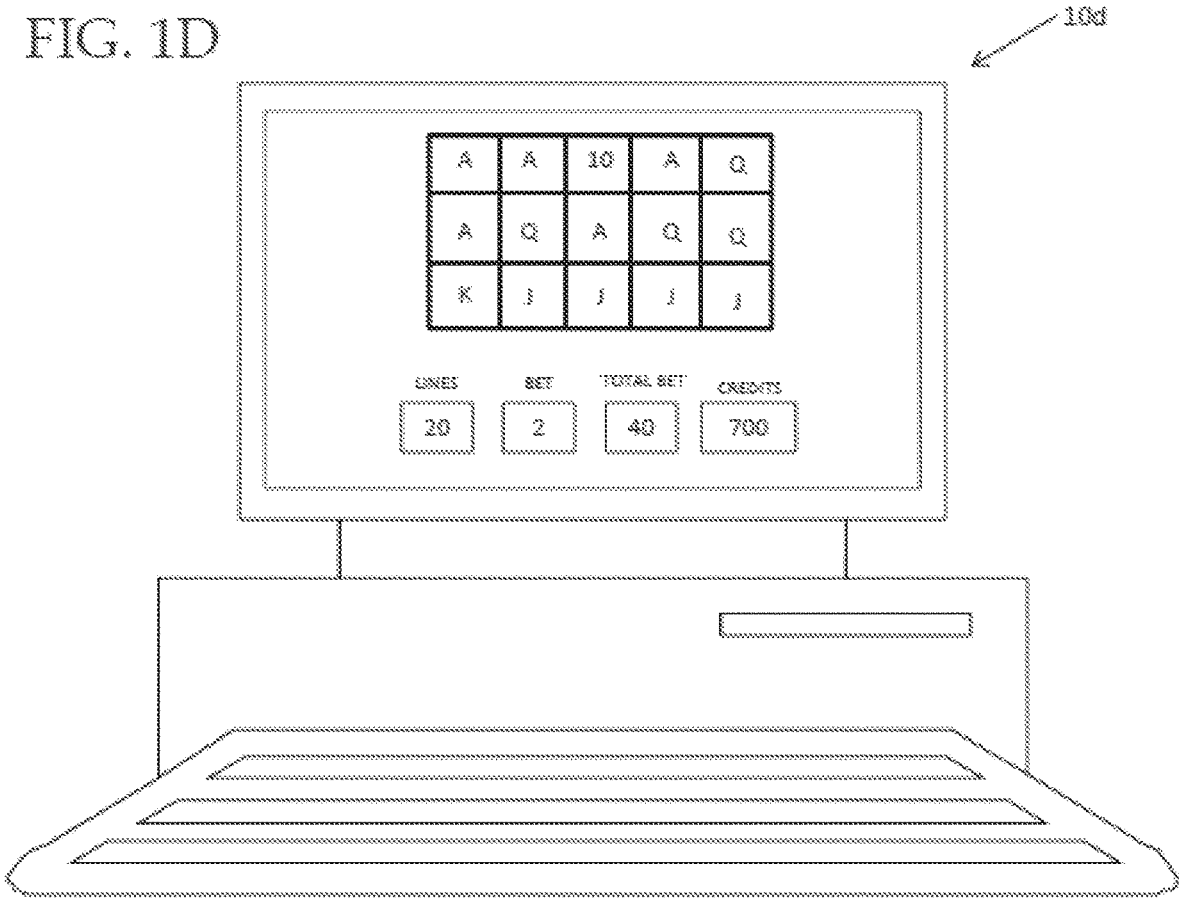
FIG. 1D depicts a front perspective view of a gaming device in the form of a personal computer in accordance with one embodiment of the present invention.
Figure 2A:
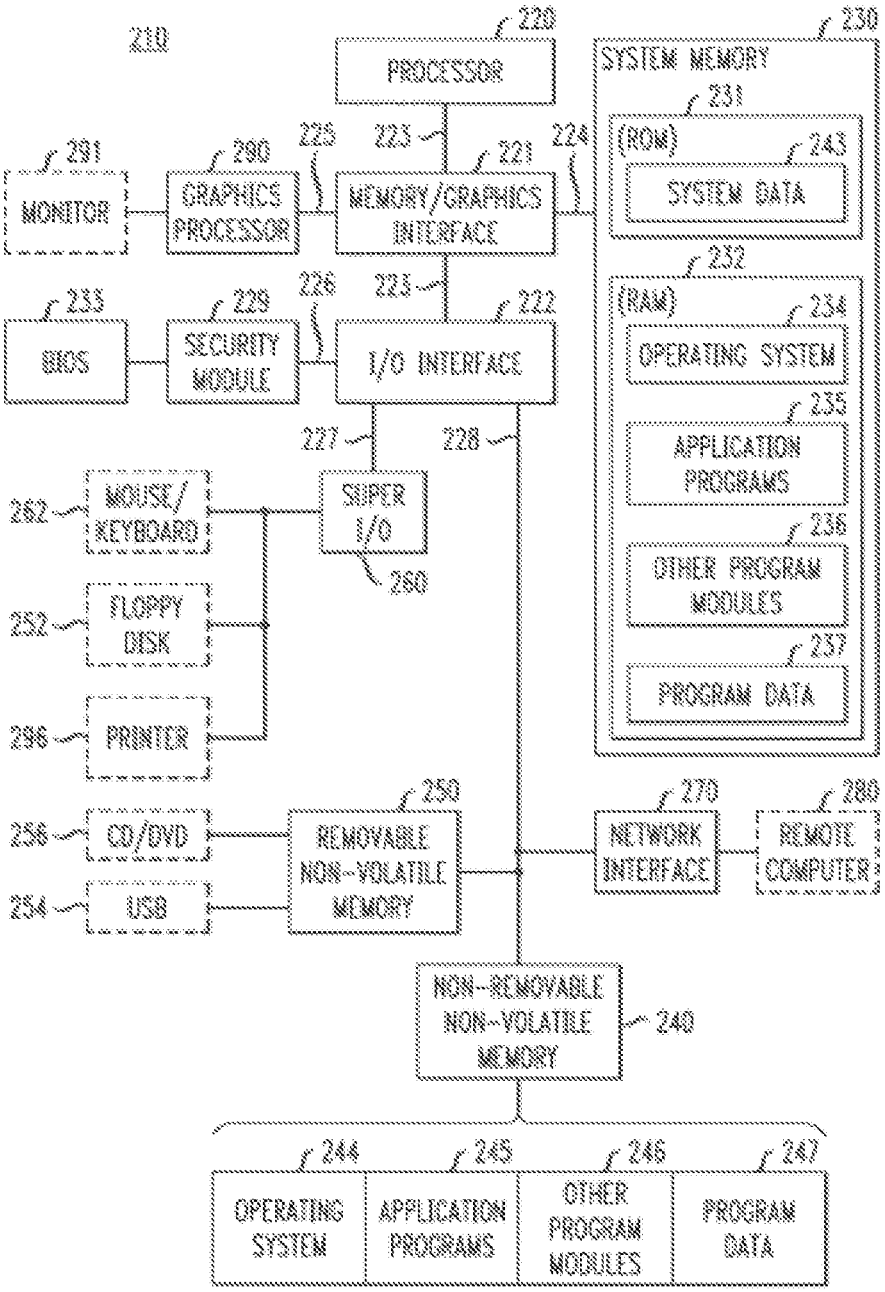
FIG. 2A depicts a schematic block diagram of a general purpose computer system, which may be used with any of the gaming devices of FIGS. 1A-1D, in accordance with embodiments of the present invention.

In several embodiments, the electronic gaming devices, for example, as shown in FIGS. 1A-1D, may comprise all or part of a general purpose computer system, for example, the general purpose computer system of FIG. 2. It should be appreciated, however, the general purpose computing system of FIG. 2 is merely an exemplary embodiment of an electronic device, and actual electronic devices may comprise any one or more components shown in FIG. 2A, suitable for embodiments of the present invention.

With reference to FIG. 2A, a general purpose computer system in the form of a computer 210 is shown. As understood by embodiments of the present invention, components shown in dashed outline are not part of the computer 210, but are used to illustrate the exemplary embodiment of FIG. 2A. Components of computer 210 may include, but are not limited to, a processor 220, a system memory 230, a memory/graphics interface 221, also known as a Northbridge chip, and an I/O interface 222, also known as a Southbridge chip. The system memory 230 and a graphics processor 290 may be coupled to the memory/graphics interface 221. A monitor 291 or other graphic output device may be coupled to the graphics processor 290.

A series of system busses may couple various system components including a high speed system bus 223 between the processor 220, the memory/graphics interface 221 and the I/O interface 222, a front-side bus 224 between the memory/graphics interface 221 and the system memory 230, and an advanced graphics processing (AGP) bus 225 between the memory/graphics interface 221 and the graphics processor 290. The system bus 223 may be any of several types of bus structures including, by way of example, and not limitation, such architectures include Industry Standard Architecture (ISA) bus, Micro Channel Architecture (MCA) bus and Enhanced ISA (EISA) bus. As system architectures evolve, other bus architectures and chip sets may be used but often generally follow this pattern. For example, companies such as Intel and AMD support the Intel Hub Architecture (IHA) and the Hyper transport architecture, respectively.

The computer 210 typically includes a variety of computer readable media. Computer readable media can be any available media that can be accessed by computer 210 and includes both volatile and nonvolatile media, removable and non-removable media. By way of example, and not limitation, computer readable media may comprise computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium that can be used to store the desired information and can accessed by the computer 210.

Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 230 includes computer storage media in the form of volatile and/or nonvolatile memory such as read only memory (ROM) 231 and random access memory (RAM) 232. The system ROM 231 may contain permanent system data 243, such as identifying and manufacturing information. In some embodiments, a basic input/output system (BIOS) may also be stored in system ROM 231. RAM 232 typically contains data and/or program modules that are immediately accessible to and/or presently being operated on by processor 220. By way of example, and not limitation, FIG. 2 illustrates operating system 234, application programs 235, other program modules 236, and program data 237.

The I/O interface 222 may couple the system bus 223 with a number of other buses 226, 227 and 228 that couple a variety of internal and external devices to the computer 210. A serial peripheral interface (SPI) bus 226 may connect to a BIOS memory 233 containing the basic routines that help to transfer information between elements within computer 210, such as during start-up.

In some embodiments, a security module 229 may be incorporated to manage receipt of money/credits, issuance of money/credits, and enforcement of policies, as may be required in the gaming industry. In many embodiments, such security module 229 may be coupled with a payment acceptor built into a physical machine. A payment acceptor may include a coin slot and a payment, note or bill acceptor, where the player inserts money, coins or tokens. For example, the player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

A super input/output chip 260 may be used to connect to a number of 'legacy' peripherals, such as floppy disk 252, keyboard/mouse/buttons 262, and printer 296, as examples.

The super I/O chip 260 may be connected to the I/O interface 222 with a low pin count (LPC) bus, in some embodiments. The super I/O chip 260 is widely available in the commercial marketplace.

In one embodiment, bus 228 may be a Peripheral Component Interconnect (PCI) bus, or a variation thereof, may be used to connect higher speed peripherals to the I/O interface 222. A PCI bus may also be known as a Mezzanine bus. Variations of the PCI bus include the Peripheral Component Interconnect-Express (PCI-E) and the Peripheral Component Interconnect-Extended (PCI-X) busses, the former having a serial interface and the latter being a backward compatible parallel interface. In other embodiments, bus 228 may be an advanced technology attachment (ATA) bus, in the form of a serial ATA bus (SATA) or parallel ATA (PATA).

The computer 210 may also include other removable/non-removable, volatile/nonvolatile computer storage media. By way of example only, FIG. 2A illustrates a hard disk drive 240 that reads from or writes to non-removable, nonvolatile magnetic media. Removable media, such as a universal serial bus (USB) memory 252 or CD/DVD drive 256 may be connected to the PCI bus 228 directly or through an interface 250. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like.

The drives and their associated computer storage media, discussed above and illustrated in FIG. 2A, provide storage of computer readable instructions, data structures, program modules and other data for the computer 210. In FIG. 2A, for example, hard disk drive 240 is illustrated as storing operating system 244, application programs 245, other program modules 246, and program data 247. Note that these components can either be the same as or different from operating system 234, application programs 235, other program modules 236, and program data 237. Operating system 244, application programs 245, other program modules 246, and program data 247 are given different numbers here to illustrate that, at a minimum, they are different elements within the computer 210. A user may enter commands and information into the computer 210 through input devices such as a mouse/keyboard 262 or other input device combination. Other input devices (not shown) may include a microphone, joystick, game pad, satellite dish, scanner, or the like. These and other input devices are often connected to the processor 220 through one of the I/O interface busses, such as the SPI 226, the LPC 227, or the PCI 228, but other busses may be used. In some embodiments, other devices may be coupled to parallel ports, infrared interfaces, game ports, and the like (not depicted), via the super I/O chip 260.

The computer 210 may operate in a networked environment using logical connections to one or more remote computers, such as a remote computer 280 via a network interface controller (NIC) 270. The remote computer 280 may be a personal computer, a server, a router, a network PC, a peer device or other common network node, and typically includes many or all of the elements described above relative to the computer 210. The logical connection between the NIC 270 and the remote computer 280 depicted in FIG. 2 may include a local area network (LAN), an Ethernet-based network, a wide area network (WAN), or both, but may also include other networks. Such networking environments are commonplace in offices, enterprise-wide computer networks, intranets, and the Internet.

Returning to FIGS. 1A-1D, in one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

As shown by FIGS. 1A and 1B, and supported by the elements depicted in FIG. 2A, many embodiments of the present invention comprise at least one, and often a plurality, of input devices in communication with the processor. The input devices can include any suitable device which enables the player to produce an input signal which is read by the processor, for instructing the game and/or gaming device to do something. In one embodiment, after appropriate funding of the gaming device, the input device is a game activation device, such as a pull arm 32 or a play button 34 which is used by the player to start any primary game or sequence of events in the gaming device. The play button can be any suitable play matching such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, one input device is a touch-screen coupled with a touch-screen controller, or some other touch-sensitive display overlay to allow for player interaction with the images on the display. The touch-screen and the touch-screen controller are connected to a video controller. A player can make decisions and input signals into the gaming device by touching touch-screen at the appropriate places.

In one embodiment, the gaming device includes a sound generating device controlled by one or more sound cards which function in conjunction with the processor. In one embodiment, the sound generating device includes at least one and preferably a plurality of speakers or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Suitable gaming devices may incorporate any suitable wagering primary or base game. The gaming machine or device of embodiments of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation from a wager. That is, different primary wagering games, such as video poker games, video blackjack games, video Keno, video bingo or any other suitable primary or base game may be implemented into an embodiment of the present invention.

In one embodiment, a base or primary game may be a slot game with one or more pay lines 52. The pay lines may be horizontal, vertical, circular, diagonal, angled or any combination thereof. In this embodiment, the gaming device displays at least one and preferably a plurality of reels 54, for example, having three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which may generally correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a pay line in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
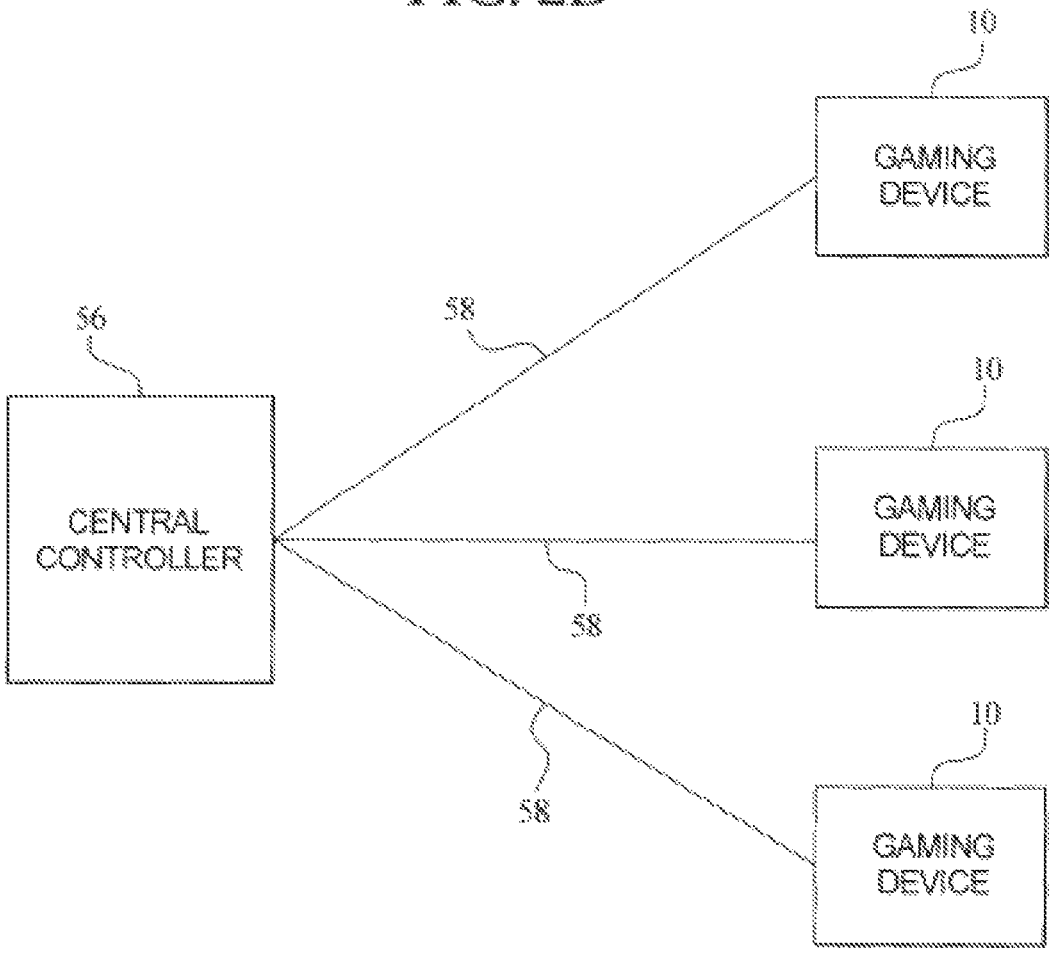
FIG. 2B depicts a schematic block diagram illustrating a plurality of gaming terminals and communication with a central controller in accordance with one embodiment of the present invention.

In one embodiment, as illustrated in FIG. 2B, one or more of the gaming devices 10 of embodiments of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of an embodiment of the present invention. In this embodiment, each of a plurality of such gaming devices is in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is a global computer network, such as the Internet, or an intranet network, and the gaming system may be considered an online system, a mobile system, or the like. In this embodiment, the operation of the gaming device can be viewed at the gaming device with at least one web browser, or application, such that access to the data network is feasible. In this embodiment, operation of the gaming device and accumulation of credits may be accomplished with a connection to the central server or controller through a conventional phone or other data transmission line, digital signal line (DSL), T-1 line, coaxial cable, fiber optic cable, or other suitable connection. In this embodiment, players may access a game page from any location where a network connection and computer, or other gaming device 10, are available. For example, either of the gaming devices of FIGS. 1C and 1D is suitable for accessing such a data network.

The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to some embodiments of the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

In some embodiments, the data network may be integrated into an existing network platform, for example, a social networking site. For example, in one embodiment, the data network may comprise an application within a social networking site, e.g., Facebook, whereby players may access the data network via a connection to the social networking site. Such an integrated arrangement may be advantageous for applications of embodiments of the present invention that seek to have near immediate access to a significant potential customer base.

In further embodiments, the data network may be accessed via a downloadable application to a mobile device, such as a smartphone, a tablet, a mobile computer, or the like. As in known in the mobile device industry, such a downloadable application may be stored at a remote server, and upon request, a player may utilize a mobile device to download such downloadable application to be stored locally on the mobile device. Such downloadable application may access the data network through the mobile device's network connection, and provide the player a convenient means through which to access the data network. In alternative embodiments, the downloadable application may not require a network connection on a regular basis, and a game may be accessible locally on the mobile device. However, in such embodiments, some of the benefits of networked game play, such as competitions, updates, etc., may not be available until the mobile device reconnects to the data network.

Figure 3:
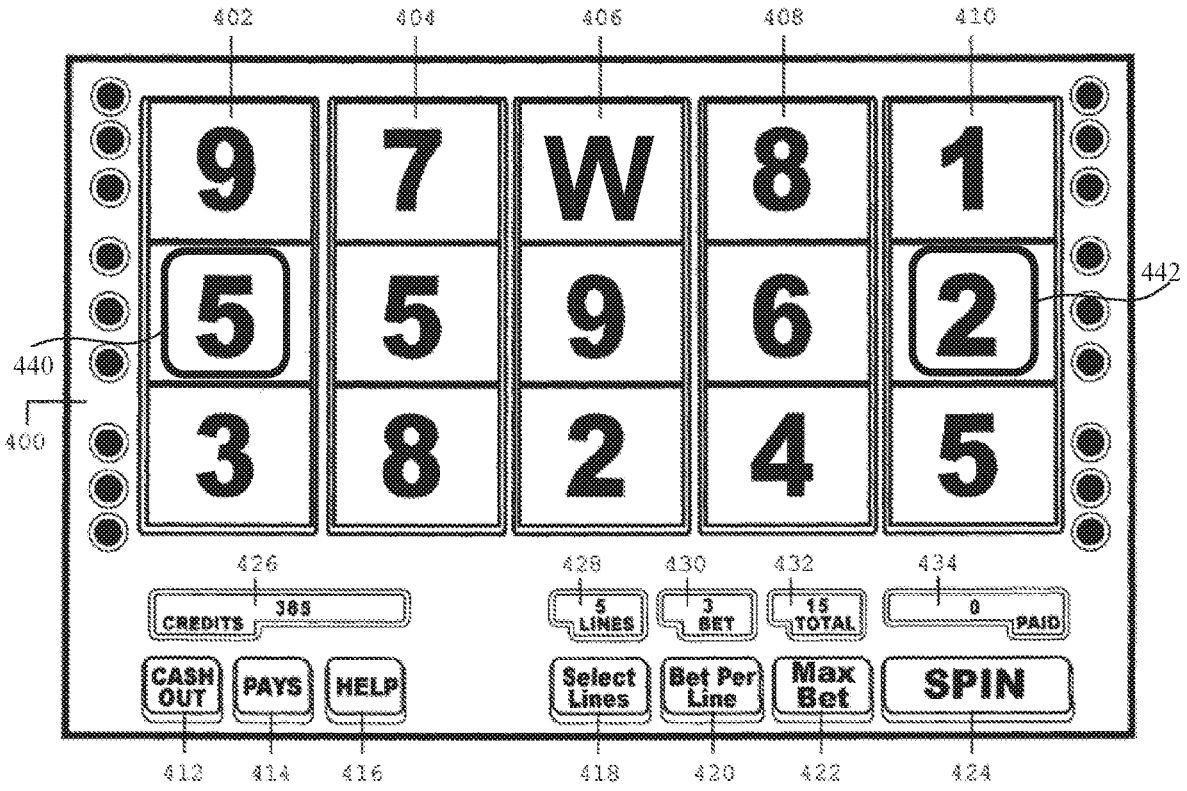
FIGS. 3-6 depict representative displays that may be encountered during a typical game in accordance with the principles of embodiments of the present invention.

FIG. 3 shows an exemplary video display 400, including a 5-column by 3-row symbol matrix, as shown on the slot reels 402-410. The first column 402, second column 404, third column 406, fourth column 408 and fifth column 410 all hold three symbols. Alternatively, the game could utilize any number of columns and reels, such as a 3-column by 3-row symbol matrix.

FIG. 3 also shows an exemplary set of control buttons 412-424 used by the player to control the functions of the slot game. These buttons may include Cash Out 412, Pay Table 414, Help 416, Select Pay Lines 418, Bet Per Line 420, Max Bet 422 and Spin 424. Any or all of these control buttons may be displayed on the video display 400 and/or buttons hard wired to the gaming device. If necessary, any number of buttons may be added or removed to further facilitate control of the games.

FIG. 3 additionally shows a set of exemplary meters 426-434 used to display the salient information for the game, including Credits 426, Number of Pay Lines 428 Amount Bet Per Line 430, Total Bet 432, and Paid 434. The Credits meter 426 displays the total number credits remaining in the credit pool. The Number of Pay Lines meter 428 is associated with the Select Pay Lines button and displays the current number of Pay Lines Selected. The Amount Bet Per Line 430 meter is associated with the Bet Per Line button 420 and displays the number of credits wagered per pay line. The Total Bet 432 meter displays the cumulative value of the Number of Pay Lines 428 and Amount Bet Per Line 430. The Paid meter 434 displays the number of credits won on the last spin.

FIG. 3 also shows an exemplary number of credits in the credit pool, as displayed on the Credits meter 426. The pool of credits increases and decreases according to the player's wins or losses and may be supplemented, if necessary, by the player by additional deposits of coins, tokens or paper currency.

Figure 7:
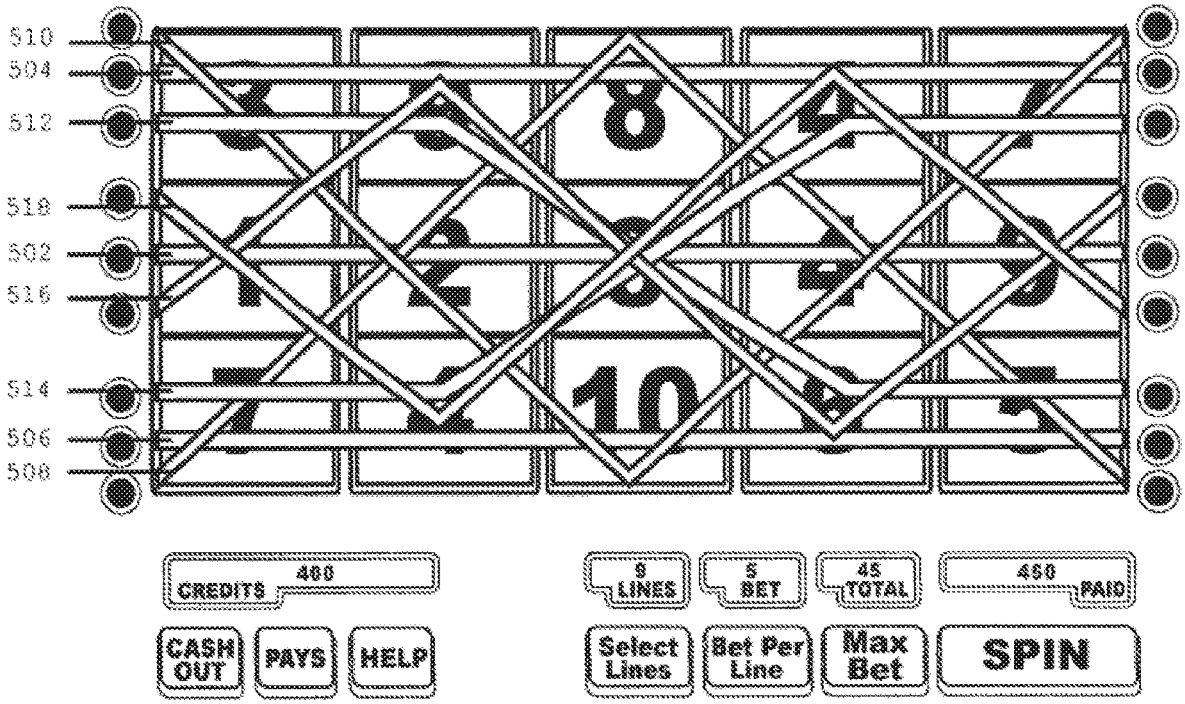
FIG. 7 shows exemplary player-selected pay lines in accordance with one embodiment of the present invention.

FIG. 3 shows an exemplary number of pay lines upon which the player wagered, as displayed on the Number of Pay Lines meter 428. More specifically, FIG. 7 shows the location of the pay lines 502-518.

In one embodiment, the pay lines activate in a predetermined order, as follows: the first wager is applied to pay line 1 at 502; the second wager is applied to pay line 2 at 504; the third wager is applied to pay line 3 at 506; the fourth wager is applied to pay line 4 at 508; the fifth wager is applied to pay line 5 at 510; the sixth wager is applied to pay line 6 at 512; the seventh wager is applied to pay line 7 at 514; the eighth wager is applied to pay line 8 at 516; the ninth wager is applied to pay line 9 at 518. However, the games may have fewer or greater than nine pay lines and utilize any order of pay line activation.

In another embodiment, the gaming device provides an outcome to the player when a designated combination of symbols such as a winning combination of symbols is indicated in symbol position on one of the pay lines 502-518. In yet another embodiment, the gaming device provides the outcome to the player when the winning symbol combination is indicated in symbol position on a plurality of the pay lines. In a further embodiment, the gaming device provides the outcome to the player when a winning symbol combination is indicated in symbol position on any of the pay lines associated with the reels. It should be appreciated that a designated combination of symbols or a winning symbol combination may be a line pay, a line scatter pay, a reel scatter pay or any suitable winning combination of the symbols.

Returning to FIG. 3, an exemplary number of credits wagered on each pay line is provided, as displayed on the Bet Per Line meter 430. Usually the same amount is wagered on each pay line. Alternatively, however, the player could be allowed to make wagers of different amounts on each pay line. The total amount wagered is determined by summing the amounts wagered on each pay line. FIG. 3 also shows the total number of credits bet on all of the pay lines, as displayed on the Total Bet meter 432. The total bet is calculated by multiplying Number of Pay Lines 428 by Bet Per Line 430.

Figure 4:
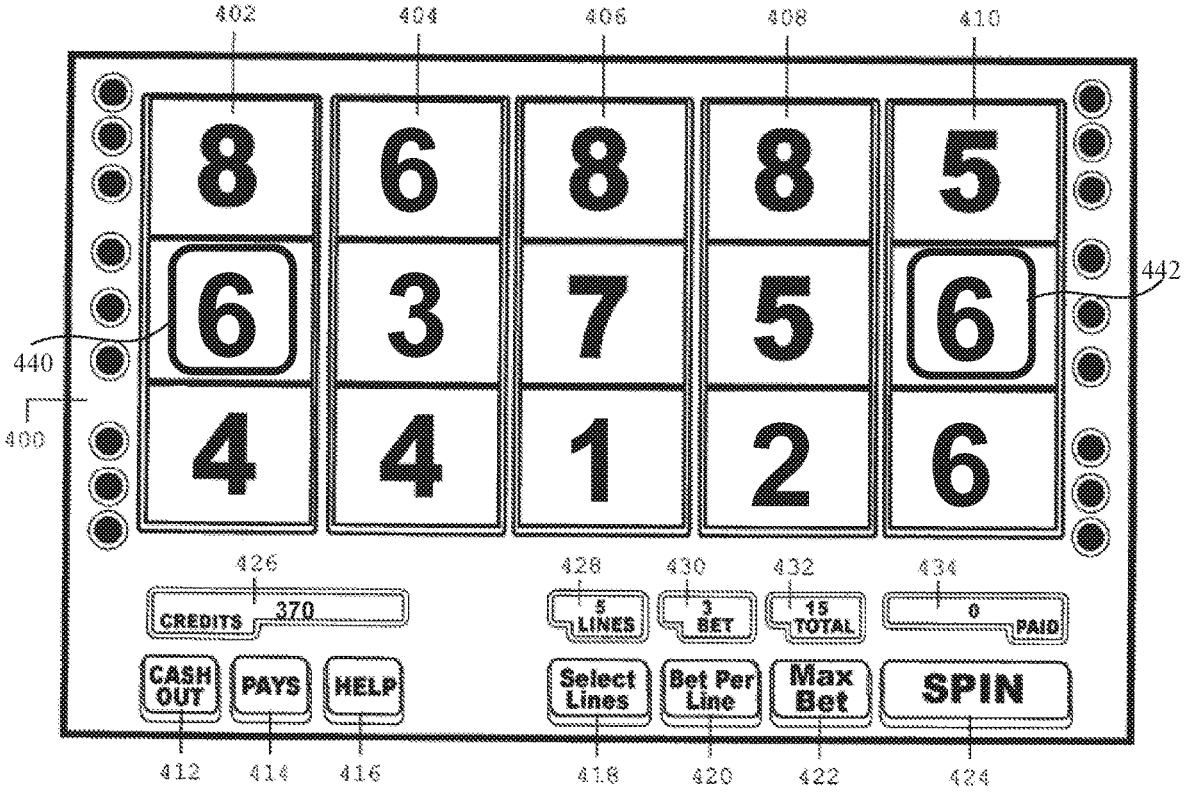
Figure 5:
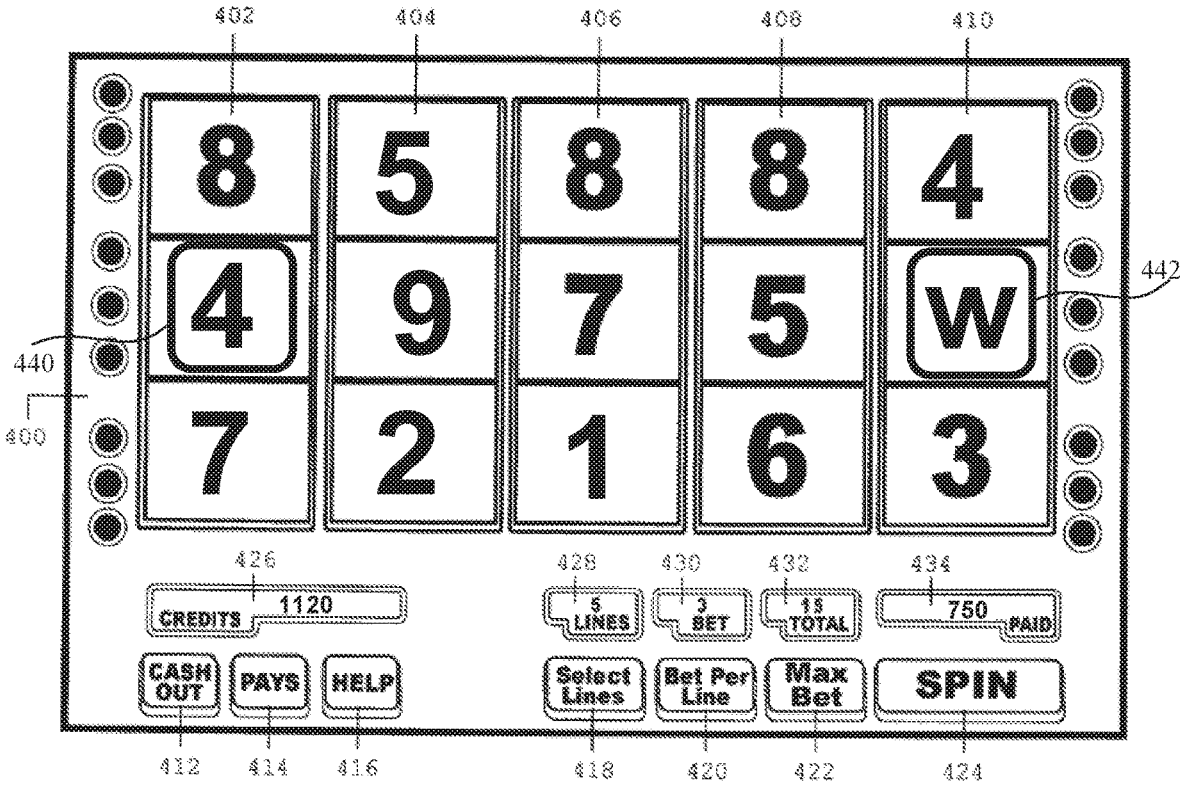
Figure 6:
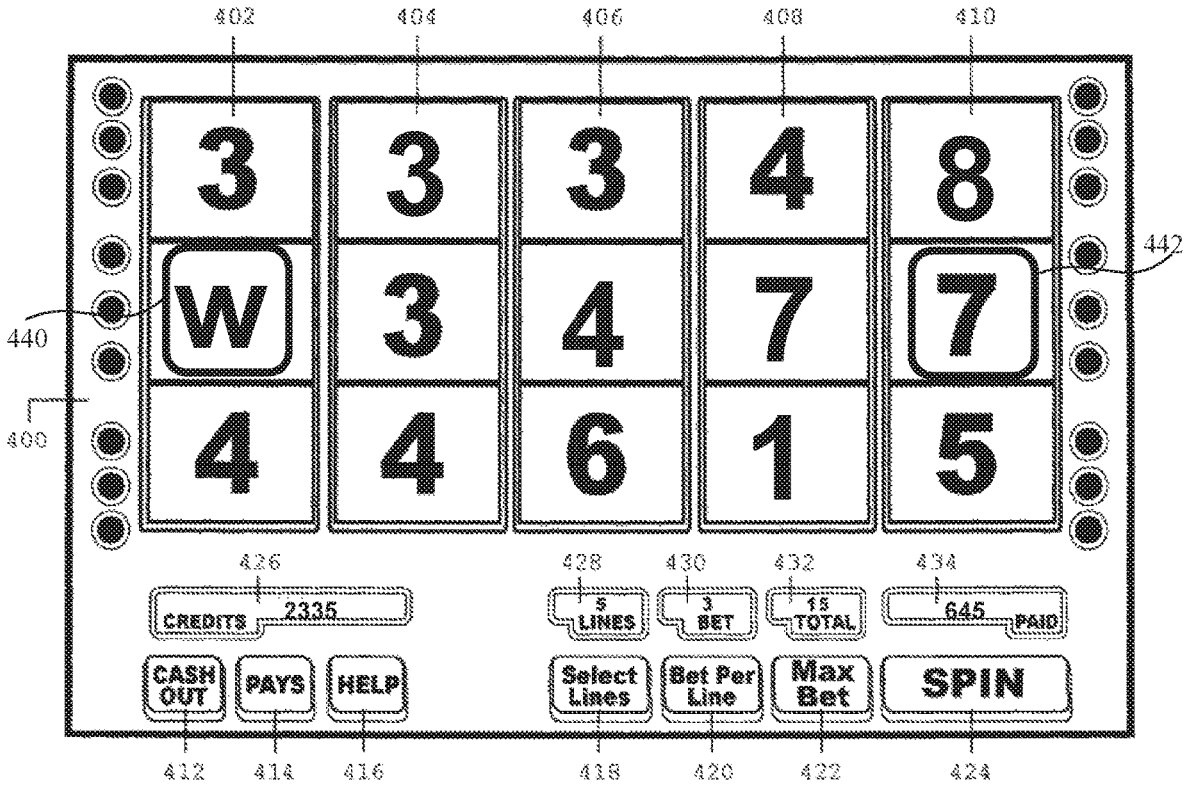

FIGS. 3-6 show an exemplary symbol set, as displayed on slot reels 402-410. As shown, there are line pays for three or more same symbols appearing adjacent to each other on an active pay line, from the leftmost pay line position towards the right. FIGS. 4 and 6 show scatter pays. Scatter pays provide an award for any one or more scatter symbols appearing anywhere on a pay line (line-scatter pay) or anywhere on the slot reels (reel-scatter pay). FIGS. 3-6 show wild symbols W, for example, as disclosed by U.S. Pat. No. 7,758,414, and incorporated by reference herein in its entirety. In addition, certain features of U.S. patent application Ser. No. 12/221,658 are related to features of embodiments of the present invention, and the disclosure of such reference is hereby incorporated by reference herein in its entirety. Wild symbols act as any symbol to help form winning combinations on active pay lines.

In some embodiments, each of the symbol positions on the reels includes a predetermined or designated symbol from the plurality of symbols. In another embodiment, each of the symbol positions on the reels includes a randomly determined symbol from the plurality of symbols, based on an algorithmic formula and distribution of symbols. It should be appreciated that any of the symbols may be in any of the symbol positions on the reels.

Generally for this invention, a position in the play matrix is designated as a capture position. So the content of the symbol on the reels that lands in the designated capture position after the reels stop spinning determines whether there will be a triggering event or an extra award. This award may be based on referencing the landed symbol against a pay table or be based on the symbols that have landed in the capture position in previous spins or the like. In some embodiments, the award depends on the number of times the particular symbol was previously captured.

In another embodiment, multiple positions in the play matrix may be designated as capture positions. Similarly, in other embodiments, new positions in the play matrix may become capture positions over the course of multiple spins.

As shown, in addition to the capture positions, the play matrix further comprises a plurality of designated matrix positions, for example, double capture positions 440 and 442 at predetermined matrix position locations. FIGS. 3-6 show two double capture positions 440, 442 at symbol positions 1/2 and 5/2 on the play matrix, respectively. For clarity, the double capture positions are highlighted in boxes in FIGS. 3-6. However, the games may have fewer or greater than two double capture positions. It should be appreciated that the double capture positions may not be highlighted in the play matrix.

It should be appreciated that the capture positions can be the same for each spin of the game, or determined for each spin. In embodiments where the capture positions can change between spins, it is envisioned that the capture positions can be determined by the processor (be it random, based on a series of spins, or through some other metric) or selected by a player at the time of placing a wager. For example, a player may be allowed to select two positions or may be given the option to pay an additional wager to select each position.

FIGS. 3-6 show different types of winning symbol combinations and triggering of additional possible paying events. An additional possible award or paying event may be triggered after a spin if the symbols located in the first designated symbol, or double capture position 440 and the second designated symbol, or double capture position 442 comprise a matching pair of base symbols or include one wild symbol and a base symbol. FIGS. 3-6 shows the slot reels after a spin. FIG. 3 provides a symbol "5" at the first double capture position 440 and a symbol "2" at the second designated real stop 442. Since the two symbols in the double capture positions 440, 442 do not match, no additional award or paying event is triggered.

FIG. 4 provides a symbol "6" at the first double capture position 440 and a symbol "6" at the second double capture position 442. Since the two symbols in the double capture positions 440, 442 are matching, an additional paying event is triggered. In some embodiments, the symbol "6" is pays as a scatter pay. As a result, reel-scatter pay is awarded in reels 402, 404 and 410, which include the scatter symbol "6" in the reels at symbol positions 1/2, 2/1 and 5/2. In other embodiments, line-scatter pay is awarded in pay lines containing the scatter symbol "6" such as pay lines 502, 504, 506, 508, 512, 516 and 518. Alternatively, any pre-determined arrangement of symbols may be designated as winning symbol combinations.

FIG. 5 provides a symbol "4" at the first double capture position 440 and a wild symbol "W" at the second double capture position 442. Since one of the two symbols in the double capture positions 440, 442 is a wild symbol, an additional paying event is triggered. The non-wild symbol "4" pays as a scatter pay. As a result, reel-scatter pay is awarded in reels 402 and 410, which include the scatter symbol "4" in the reels at symbol positions 1/2 and 5/1. In other embodiments, line-scatter pay is awarded in pay lines containing the scatter symbol "4" such as pay lines 502, 504, 510, 512, 516 and 518.

FIG. 6 provides a wild symbol W at the first double capture position 440 and a symbol "7" at the second double capture position 442. Since one of the two symbols in the double capture positions 440, 442 is a wild symbol, an additional paying event is triggered. The non-wild symbol "7" pays as a scatter pay. As a result, reel-scatter pay is awarded in reels 408 and 410, which include the scatter symbol "7" in the reels at symbol positions 4/2 and 5/2. In other embodiments, line-scatter pay is awarded in pay lines containing the scatter symbol "7" such as pay lines 502, 508, 510, 516 and 518. In addition, the symbol matrix in FIG. 6 contains a winning 3-3-3 combination on pay line 504.

In some embodiments, a wild symbol does not count as a match for the purposes of a double-capture triggering event.

It should be appreciated that a triggered award can be any award event. Described above and illustrated in the figures is issuing a scatter pay award in a game that primarily has line pays. Alternatively, a double-capture event could upgrade all corresponding matching symbols—such as making them wild, double in value, or double in quantity, or any other award as is well-known by those skilled in the art. Further, the additional award can be a bonus game or free spins.

Additionally, the game may not need to reference a paytable to issue the additional award. For example, this invention contemplates if two "6" symbols match in the double-capture, the game could issue 6 free spins.

In a base example game, a player is standing in front of a nickel-denomination version of an embodiment of the present invention. The player sees slot game on a video display 400, illustrated for example in FIG. 3. The slot game uses a 5-column by 3-row symbol matrix, as shown on the slot reels 402-410. For this example, video display 400 is populated with symbols and/or information described below which replaces the symbols and/or information currently displayed in FIG. 3.

Below the video display 400, the button panel holds seven buttons: Cash Out 412, Pay Table 414, Help 416, Select Pay Lines 418, Bet Per Line 420, Bet Max 422, and Spin 424. In addition, there are also five meters on the video display 400 below the game: Credits 426, Number of Pay Lines 428, Amount Bet Per Line 430, Total Bet 432 and Paid 434.

The player presses the Pay Table button 414 to view the pays for winning combinations. After viewing the pay table, the player deposits $20 into the bill receptor and the Credits meter 426 counts up from 0 to 400 since the denomination for this game is five cents per credit. The player then his chooses the wager for the game: The game's Number of Pay Lines meter 428 reads 1. The player presses the Select Pay Lines button 418 four times and the Number of Pay Lines meter 428 counts up from 1 to 5. An exemplary set of pay lines used in this example is illustrated in FIG. 7. As the player presses the Select Pay Lines button 418, the video display 400 shows the locations of each selected pay line on the slot reels 402-410. For example, the first pay line 502 starts in the middle row of slot reel 402 and proceeds in the straight line through the middle position of slot reels 404-410; The game's Amount Bet Per Line meter 430 reads 1. The player presses the Bet Per Line button 420 two times and the Amount Bet Per Line meter 430 counts up from 1 to 3; The Total Bet meter 432 started at 1, but after Sam's adjustments it now reads 15; and The Paid meter 434 reads 0.

After setting his wager, the player presses the spin button 424. The Credits meter 426 counts down from 400 to 385. The slot reels 402-410 spin, stop, and display a variety of symbols. The symbol matrix contained no winning combinations. The two double capture positions in boxes at symbol positions 1/2 and 5/2 do not contain a matching pair of symbols nor a wild symbol. No additional award or paying event is triggered.

Once again, after setting the same wager, the player presses the spin button 424. The Credits meter 426 counts down from 385 to 370. The slot reels 402-410 spin, stop, and display a variety of symbols. The symbol matrix contained no winning combinations. The two double capture positions in boxes at symbol positions 1/2 and 5/2 includes a pair of matching symbols "6" and triggers an additional award or paying event. Reel-scatter pay is awarded in reels 402, 404 and 410, which include a scatter pay based on the "6" in the reels at symbol positions 1/2, 2/1 and 5/2. Line-scatter pay is awarded in pay lines containing the symbol "6" such as pay lines 502, 504, 506, 508, 512, 516 and 518.

The game awards 750 credits for the reel-scatter pay and line-scatter pay. The 525 credit award reflects the game's pay table which states that line scatter pays 25 credits for each credit wagered upon the pay line (e.g., 25 credits times 3 credits wagered on each pay line for a total of 7 pay lines containing the scatter symbol). The remaining 225 credit award reflects the game's pay table which states that reel scatter pays 25 credit times 3 credits wagered upon each scatter on a reel, for a total of 3 reels. The Credits meter 426 counts up from 370 to 1120 and the game Paid meter 434 reads 750.

Again, the player presses the spin button 424. The Credits meter 426 counts down from 1120 to 1105. The slot reels 402-410 spin, stop, and display other symbols. The symbol matrix contains no winning combinations. The two double capture positions in boxes at symbol positions 1/2 and 5/2 includes a "4" and a wild symbol, and triggers an additional award or paying event. Reel-scatter pay is awarded in reels 402 and 410, which include the scatter symbol "4" in the reels at symbol positions 1/2 and 5/1. In other embodiments, line-scatter pay is awarded in pay lines containing the scatter symbol "4" such as pay lines 502, 504, 510, 512, 516 and 518.

The game awards 600 credits for the reel-scatter pay and line-scatter pay. The 450 credit award reflects the game's pay table which states that line scatter pays 25 credits for each credit wagered upon the pay line (e.g., 25 credits times 3 credits wagered on each pay line for a total of 6 pay lines containing the scatter symbol). The remaining 150 credit award reflects the game's pay table which states that reel scatter pays 25 credit times 3 credits wagered upon each scatter on a reel, for 2 reels containing a scatter pay. The Credits meter 426 counts up from 1105 to 1705 and the game Paid meter 434 reads 600.

Again, the player presses the spin button 424. The Credits meter 426 counts down from 1705 to 1690. The slot reels 402-410 spin, stop, and display other symbols. The symbol matrix contains a winning combination of 3-3-3 in pay line 504. The 120 credit award reflects the game's pay table which states that 3-3-3 pays 40 credits for each credit wagered upon the pay line (e.g., 40 credits times 3 credits wagered on the pay line). The two double capture positions in boxes at symbol positions 1/2 and 5/2 includes the wild symbol and a "7," and triggers an additional award or paying event. In the figure, the additional award is in the form of a scatter pay. Reel-scatter pay is then awarded in reels 408 and 410. In other embodiments, line-scatter pay is awarded in pay lines containing the scatter symbol such as pay lines 502, 508, 510, 516 and 518.

The game awards 645 credits for the reel-scatter pay and line-scatter pay. The 120 credit award reflects the payout for winning combination of 3-3-3. The 375 credit award reflects the game's pay table which states that line scatter pays 25 credits for each credit wagered upon the pay line (e.g., 25 credits times 3 credits wagered on each pay line for a total of 5 pay lines containing the scatter symbol). The remaining 150 credit award reflects the game's pay table which states that reel scatter pays 25 credit times 3 credits wagered upon each scatter on a reel, for 2 reels containing a scatter pay award. The Credits meter 426 counts up from 1690 to 2335 and the game Paid meter 434 reads 645.

Content with his winnings, the player presses the Cash Out button 412. The gaming device issues 2335 nickels or any other form of currency, including cash, an EZ-PAY™ ticket, or electronic payment.

It should be noted that the wild symbols in FIGS. 3-6 do not act as scatter symbols, but in alternative embodiments, upon a triggering double-capture event, there could be a scatter pay award associated with the wild symbols according to a paytable. In some embodiments, the double-capture payout including a wild symbol may be greater or less than the payout if it were made without a wild symbol. Alternatively, wild symbols may also act as any or all types of scatter symbols, and optionally simultaneously therewith.

The Scatter pays illustrated in FIGS. 4-6 issue a specific number of credits. The credits may be issued immediately or after the completion of a bonus feature e.g., animation sequence or animated bonus game).

The pays in the above examples issue a specific number of credits. The credits may be issued immediately or after the completion of a bonus feature e.g., animation sequence or animated bonus game). The calculation of the scatter pay award depends on the type of scatter pay: For the line scatter pay, the number of credits wagered on the winning pay line multiplies the number of credits indicated by the pay table. For example, the player wagered three credits each on five pay lines and collected three times the amount indicated on the pay table. For the reel scatter pay, the total number of credits wagered multiplies the number of credits indicated by the pay table. Alternatively, any award schedule may be used to pay for any pre-determined arrangement of scatter symbols—line-scatter or reel-scatter.

Embodiments of the present invention further include a variety of methods of play that can be programmed on an electronic video slot machine to enable wild symbols to be created in the play matrix. In the exemplary method, "Double Capture" comprises a matching pair of symbols or a symbol with a wild symbol on the reel strip. The presence of these pairs of matching symbols or a combination of a wild symbol and a base symbol in the play matrix on a given spin triggers an additional paying or award event.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. For example, an element disclosed by one embodiment of the present invention may be included in any other disclosed embodiment, where suitable. All such modifications and variations are intended to be included herein within the scope of this disclosure and the present invention.

What is claimed is:

1. A gaming machine comprising:

a plurality of reels, each of the reels comprising a plurality of symbol positions;

a plurality of symbols, at least one of the plurality of symbols located in at least one of the plurality of symbol positions;

a visible matrix on a display device comprising a plurality of matrix positions;

one of the matrix positions designated as a first capture position;

one of the matrix position designated as a second capture position;

an input device configured accept and validate an item associated with a monetary value, the monetary value establishing a credit balance, the credit balance being increasable and decreasable based on at least wagering activity and trigger a set of program instructions executable to implement:

accepting a wager the wager amount decreasing the credit balance;

receiving an instruction to initiate play of the game;

determining a stop position for each of the plurality of reels using a random number generator wherein the determining is independent of the location of the first capture position and the second capture position;

displaying a portion of the reels based on each reel's stop position in the visible matrix on the display device;

determining whether to issue an award based on the symbols in the first capture position and the second capture position;

issuing the award if the program instructions so designate; and detecting a command from the input device to cause the initiation of a payout, via a cashout device.

2. The gaming machine of claim 1, wherein the award is issued if the symbols in the capture positions are the same.

3. The gaming machine of claim 2, wherein the symbols in the capture positions are the same if a wild symbol is in a capture position.

4. The gaming machine of claim 1 wherein the capture positions are fixed.

5. The gaming machine of claim 1 wherein the capture positions are selected for a spin of the game.

6. The gaming machine of claim 5 wherein the capture positions are selected by a processor.

7. The gaming machine of claim 5 wherein the capture positions are selected by a player.

8. The gaming machine of claim 1 wherein the award is a monetary award.

9. The gaming machine of claim 1 wherein the award is for a bonus game.

10. The gaming machine of claim 1 wherein the award is to upgrade symbols in the visible play matrix.

11. The gaming machine of claim 10 wherein the award is to turn all symbols that match the symbols in the capture positions to wild symbols.

12. The gaming machine of claim 10 wherein the award is to increase the value of a payline award for all symbols that match the symbols in the capture positions.

13. A game machine comprising:

a plurality of reels, each of the reels comprising a plurality of symbol positions;

a plurality of symbols, at least one of the plurality of symbols located in at least one of the plurality of symbol positions;

a visible matrix on a display device comprising a plurality of matrix positions;

an input device configured to accept and validate an item associated with a monetary value, the monetary value establishing a credit balance, the credit balance being increasable and decreaseable based on at least wagering activity;

one of the matrix positions designated as a first capture position;

one of the matrix positions designated as a second capture position;

a set of program instructions executable to implement:

accepting a wager through the input device;

receiving an instruction to initiate play of the game through the input device;

determining a game outcome including a stop position for each of the plurality of reels using a random number generator wherein the stop positions are not based on the locations of the capture positions;

displaying a portion of the reels based on each reel's stop position in the visible matrix;

determining whether to issue an award based on the symbols in the first capture position and in the second capture position;

issuing the award if the program instructions so designate; and detecting a command from the input device to cause the initiation of a payout, via a cashout device.

14. A method of operating a game machine comprising:

providing a game machine comprising:

a plurality of reels, each of the reels comprising a plurality of symbol positions;

a plurality of symbols, at least one of the plurality of symbols located in at least one of the plurality of symbol positions;

an input device configured to accept and validate an item associated with a monetary value, the monetary value establishing a credit balance, the credit balance being increasable and decreaseable based on at least wagering activity;

a visible matrix on a display device comprising a plurality of matrix positions;

one of the matrix positions designated as a first capture position;

one of the matrix positions designated as a second capture position;

a set of program instructions executable to implement:

accepting a wager through the input device;

receiving an instruction to initiate play of the game through the input device;

generating a random number for each of the plurality of reels using a random number generator wherein the random numbers are independent of the locations of the first capture position and the second capture position;

determining a game outcome including a stop position for each of the plurality of reels based on the random number for each reel;

displaying a portion of the reels based on each reel's stop position in the visible matrix;

determining whether to issue an award based on the symbols in the capture positions;

issuing an award if the program instructions so designate; and detecting a command from the input device to cause the initiation of a payout, via a cashout device.

15. The method of claim 14 wherein the award is issued if the symbols in the capture positions match.

16. The method of claim 15 wherein the symbols in the capture positions match if one of them is a wild symbol.

17. The method of claim 14 wherein the capture positions are fixed.

18. The method of claim 14 wherein the capture positions are selected for a spin of the game.

19. The method of claim 14 wherein the award is a monetary award.

20. The method of claim 14 wherein the award is to upgrade symbols in the visible play matrix.

* * * * *